US006630635B1

(12) United States Patent
Doepner

(10) Patent No.: US 6,630,635 B1
(45) Date of Patent: Oct. 7, 2003

(54) UNIVERSAL CONTACT SWITCH

(75) Inventor: Matthias F. W. Doepner, Harleysville, PA (US)

(73) Assignee: Connector Set Limited Partnership, Hatfield, PA (US)

( * ) Notice: Subject to any disclaimer, the term of this patent is extended or adjusted under 35 U.S.C. 154(b) by 14 days.

(21) Appl. No.: 10/199,903

(22) Filed: Jul. 19, 2002

Related U.S. Application Data

(63) Continuation-in-part of application No. 10/059,805, filed on Jan. 29, 2002.

(51) Int. Cl.[7] ..... A63D 3/02

(52) U.S. Cl. ..... 200/6 A; 200/61.11; 223/121 A

(58) Field of Search ..... 200/4, 5 R, 6 A, 200/17 R, 18, 61.1, 61.11, 517; 273/118 A, 119 A, 118 D, 121 A, 122 A, 122 R, 127 R, 127 A, 127 C, 129 S

(56) References Cited

U.S. PATENT DOCUMENTS

| | | | | |
|---|---|---|---|---|
| 2,109,678 A | | 3/1938 | Nelson | 200/52 |
| 2,163,122 A | | 6/1939 | Hooker | 273/118 |
| 2,184,868 A | | 12/1939 | Williams et al. | 200/52 |
| 2,212,097 A | | 8/1940 | Gensburg | 200/52 |
| 2,275,005 A | | 3/1942 | Bevington | 273/118 |
| 2,277,274 A | | 3/1942 | Stoner et al. | 200/52 |
| 2,302,184 A | | 11/1942 | Caestecker | 200/52 |
| 2,311,392 A | | 2/1943 | Heiss | 200/52 |
| 2,487,979 A | | 11/1949 | Neyens | 200/52 |
| 2,501,021 A | | 3/1950 | Benak | 273/118 |
| 2,727,743 A | | 12/1955 | Stoeser | 273/118 |
| 2,804,514 A | | 8/1957 | Peters | 200/61.11 |
| 3,699,296 A | | 10/1972 | Harris | 200/67 DB |
| 3,906,176 A | * | 9/1975 | Carlson | 200/43.04 |
| 4,171,470 A | * | 10/1979 | Gettig | 200/6 A |
| 4,203,602 A | | 5/1980 | Kral | 273/121 A |
| 4,247,109 A | * | 1/1981 | Horan et al. | 273/121 A |
| 4,408,103 A | * | 10/1983 | Smith, III | 200/6 A |
| 4,748,441 A | * | 5/1988 | Brzezinski | 200/6 A |
| 4,896,003 A | * | 1/1990 | Hsieh | 200/6 A |
| 4,975,547 A | * | 12/1990 | Nakayama et al. | 200/5 R |
| 4,992,631 A | * | 2/1991 | Gee | 200/5 A |
| 5,349,881 A | * | 9/1994 | Olorenshaw et al. | 200/6 A |
| 5,496,977 A | * | 3/1996 | Date et al. | 200/6 A |
| 5,536,911 A | * | 7/1996 | Madill | 200/6 A |
| 5,675,309 A | * | 10/1997 | DeVolpi | 200/6 A |
| 6,084,189 A | * | 7/2000 | Menche et al. | 200/315 |

* cited by examiner

*Primary Examiner*—Michael Friedhofer
(74) *Attorney, Agent, or Firm*—Schweitzer Cornman Gross & Bondell LLP

(57) ABSTRACT

A tilt contact switch for kinetic activity amusement games, for example pin ball games. A spherical tilt element is confined within a spherical socket and mounted below an opening in a game board surface panel. A contact bumper is mounted by the spherical tilt element and extends above the game board surface for engagement by a moving ball or the like. A wobble plate is fixed to the spherical tilt element and positioned closely adjacent to a switch element molded of soft, elastic silicone rubber material formed with spaced contact bumps. Tilting of the wobble plate, as a result of contact with the bumper, will deform and depress one or more of the contact bumps, serving to complete an electrical circuit through circuit contacts underlying a depressed contact bump. The resiliency of the contact bumps serves to bias the wobble plate to a normal or rest position when tilt forces are removed from the contact bumper. Desirably, the contact bumper is removably mounted on the spherical tilt element and can be replaced by a cover element, to permit reconfiguration of the game board for use without the presence of a particular contact bumper.

8 Claims, 6 Drawing Sheets

UNIVERSAL CONTACT SWITCH

RELATED APPLICATIONS

This application is related to my applications Ser. No. 10/059,748 and 10/059,805, filed Jan. 29, 2002, relating respectively to a construction toy for making electronic arcade games and the like, and to a contact switch device useful in connection therewith, and is a continuation-in-part of application Ser. No. 10/059,805.

FIELD OF THE INVENTION

The present invention pertains to the field of contact switches, and in particular, to contact switches for kinetic activity amusement games and the like.

BACKGROUND OF THE INVENTION

Kinetic activity amusement games, such as pin ball and the like, typically include a game board having a playing surface with a plurality of deflectors and obstacles attached thereto, one or more game balls, and means to urge the game balls onto and within the game board.

Amusement games of the type referred to typically include electronic contact switches having bumper portions responsive to impact by a game ball rolling on the game board such that, when a game ball impacts the contact switch with sufficient energy, the contact switch is temporarily actuated to complete (or interrupt) an electrical circuit through the switch. The changed state of the contact switch can serve to increment a game score, or can serve some other game-related purpose such as initiating a sound or a secondary kinetic activity in the game board. The contact switches typically include means to bias the switch into a rest position (usually an electrically "open" condition), such that after an impact of the switch by a game ball and the subsequent rebound of the game ball, the contact switch returns to the rest (i.e., open) position.

SUMMARY OF THE INVENTION

The present invention pertains to a contact switch for a kinetic activity amusement game, such as described above, having novel and improved features. A typical kinetic activity amusement game, in which the contact switch of the invention may be employed, has a game board with a playing surface upon which a game ball may roll. The contact switch of the invention has a contact bumper located above the playing surface of the game board. The contact bumper is preferably removably connected to a universal joint having a ball mounted within a complementary socket located within an interior space of the game board. The contact bumper is responsive to impact by a game ball rolling on the game board, approaching from any angle, such that when a game ball impacts the contact bumper with sufficient kinetic energy, the contact bumper deflects (i.e., tilts about the center of rotation of the ball and socket joint) and the contact switch is temporarily closed, completing an electrical circuit through the switch. The closed state of the contact switch can serve to increment a game score, or can serve some other game-related purpose such as initiating a sound or a secondary kinetic activity in the game board.

Pursuant to one aspect of the invention, a novel and improved contact switch is provided, specially adapted for the purposes indicated, which incorporates a universally pivotable ball and socket joint. The ball member is provided on its upper side with a recess for the removable reception of a contact bumper element, to serve as a contact element for engagement with a rolling ball. A cover element can be inserted into the ball element recess when the bumper is removed, to provide an uninterrupted game board surface.

In a preferred embodiment of the invention, a projection extends downward from the ball swivel element and mounts a circular wobble plate. The wobble plate and projection are fixed to the ball swivel, such that the wobble plate is tilted by pivoting movement of the ball in any direction, for example as a result of contact with a moving ball during operation of the kinetic activity amusement game.

According to an aspect of the invention, the wobble plate is positioned directly above and substantially in contact with a resilient switch element, formed of a soft, rubber-like material provided with a plurality of upwardly projecting, elastically displaceable contact bumps positioned at regularly spaced intervals around edge areas of the wobble plate and directly underlying the bottom surface of the wobble plate. When the spherical tilt element is tilted in any direction, the wobble plate is angularly displaced so that portions thereof bear downward on one or more of the contact bumps, causing elastic displacement thereof and resulting in electrical contact being made with underlying printed circuit elements, to effect the desired circuit action. The inherent resiliency of the rubber contact element is such that, when the displacing force on the ball element is released (i.e., the ball that contacted the bumper has moved away) the resilient contact element restores the wobble plate to a neutral or horizontal position, returning the bumper element to a normal, vertically oriented position above the game board.

For a more complete understanding of the above and other features and advantages of the invention, reference should be made to the following detailed description of a preferred embodiment thereof, and to the accompanying drawings.

DESCRIPTION OF PREFERRED EMBODIMENT

Figure 1:
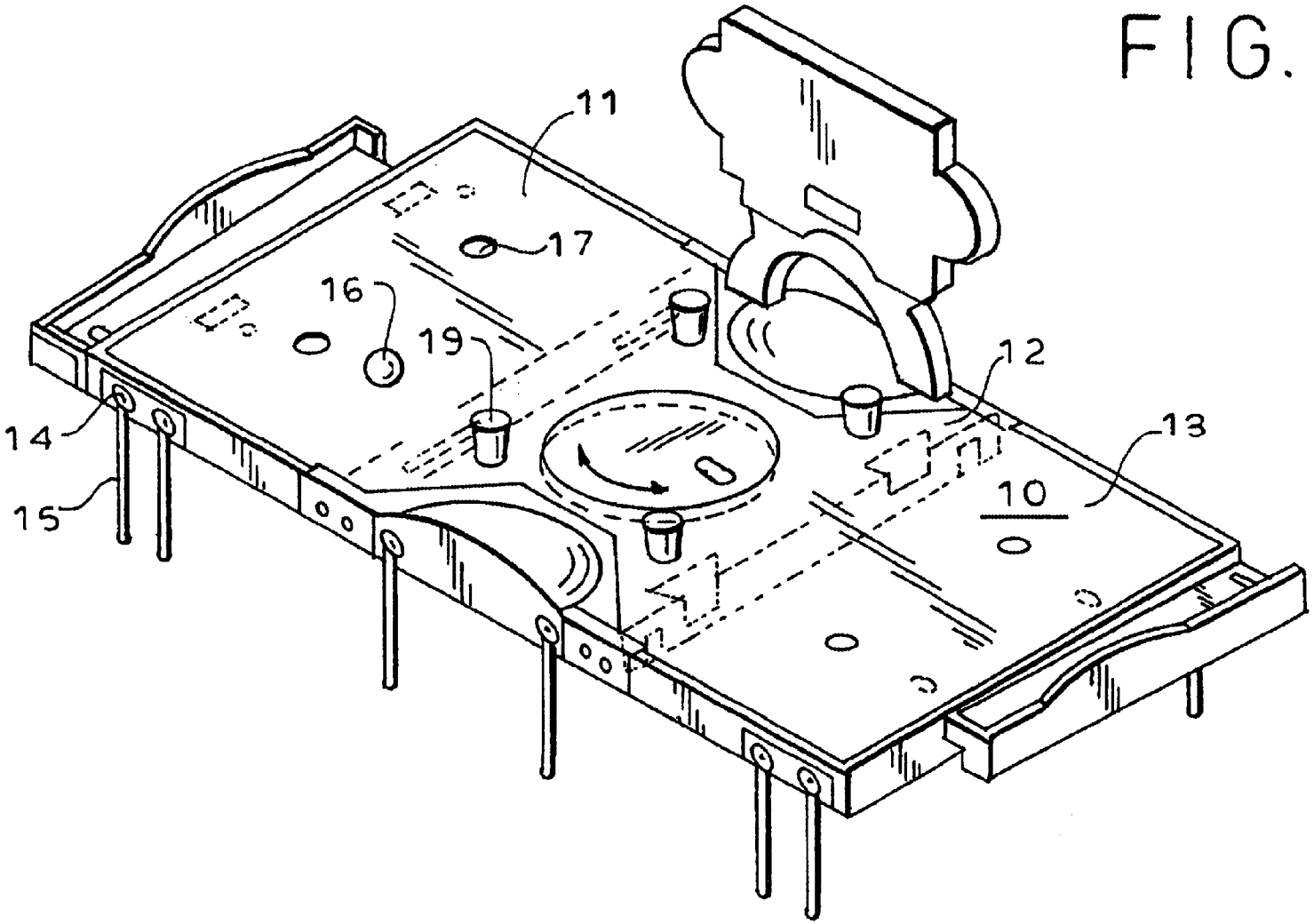
FIG. 1 is a perspective view of a kinetic activity amusement game having a contact switch constructed according to the present invention.
Figure 2:
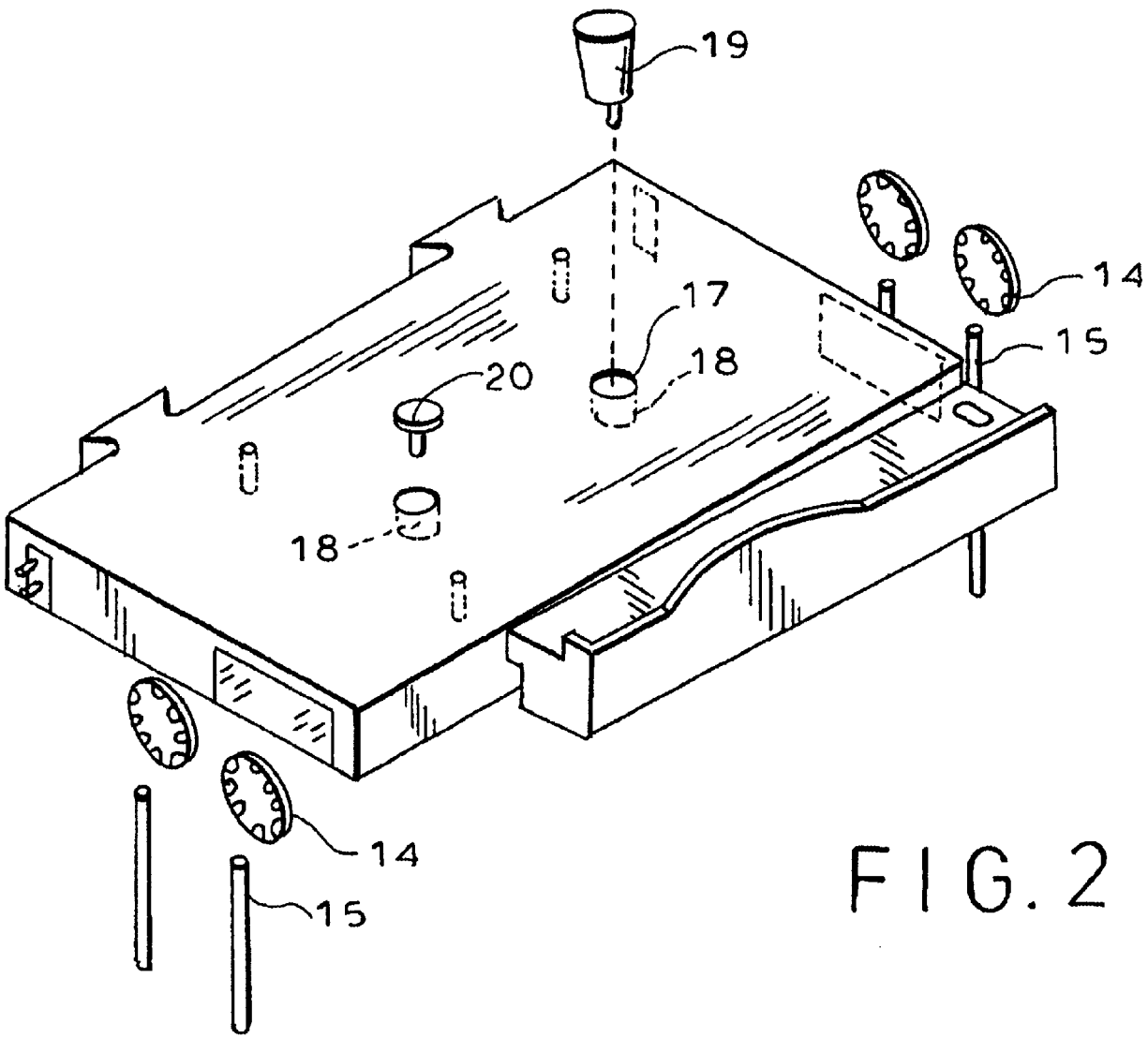
FIG. 2 is an exploded perspective view of a segment of the game board of FIG. 1, illustrating the alternative placement of contact bumper elements and cover elements in the contact switch devices of the invention.

Referring now to the drawings, and initially to FIGS. 1 and 2 thereof, the reference numeral 10 designates generally a kinetic activity game of a type described and claimed in my copending application Ser. No. 10/059,748, intended to be a build-it-yourself game structure, utilizing components of the well known K'NEX construction toy system and adapted to be configured in various ways to play a variety of kinetic activity games. A game board structure is provided which consists of a plurality of interconnected game board sections 11–13 collectively forming a generally flat surface suitably supported on a structural assembly formed of K'NEX components indicated in an oversimplified, schematic way by connector elements 14 and rod elements 15.

Among various configurations possible with the game board 10 is a pin ball configuration, for example, in which the game board is supported at a shallow incline, and ball elements 16 are injected onto an upper portion of the board by suitable shooter means (not shown).

At various locations about the surface of the board sections 11–13 openings 17 are provided, and located at each such opening is a contact switch 18 (FIG. 3) which is mounted to the underside of the game board panel directly below the opening. Each of the contact switches 18 is adapted, in a manner to be described more fully, alternatively to receive a bumper element 19 or a cover element 20 (see FIG. 2). When bumpers 19 are installed, they form obstacles subject to engagement by the rolling ball 16. When a bumper is contacted and displaced by a moving ball, a switch contact is closed and a game activity, such as incrementing of the game score, is effected. When a bumper 19 is removed, for example to re-configure the game board, a cover element 20 is inserted in its place, to form a relatively smooth continuation of the surface of the game board panel.

Figure 3:
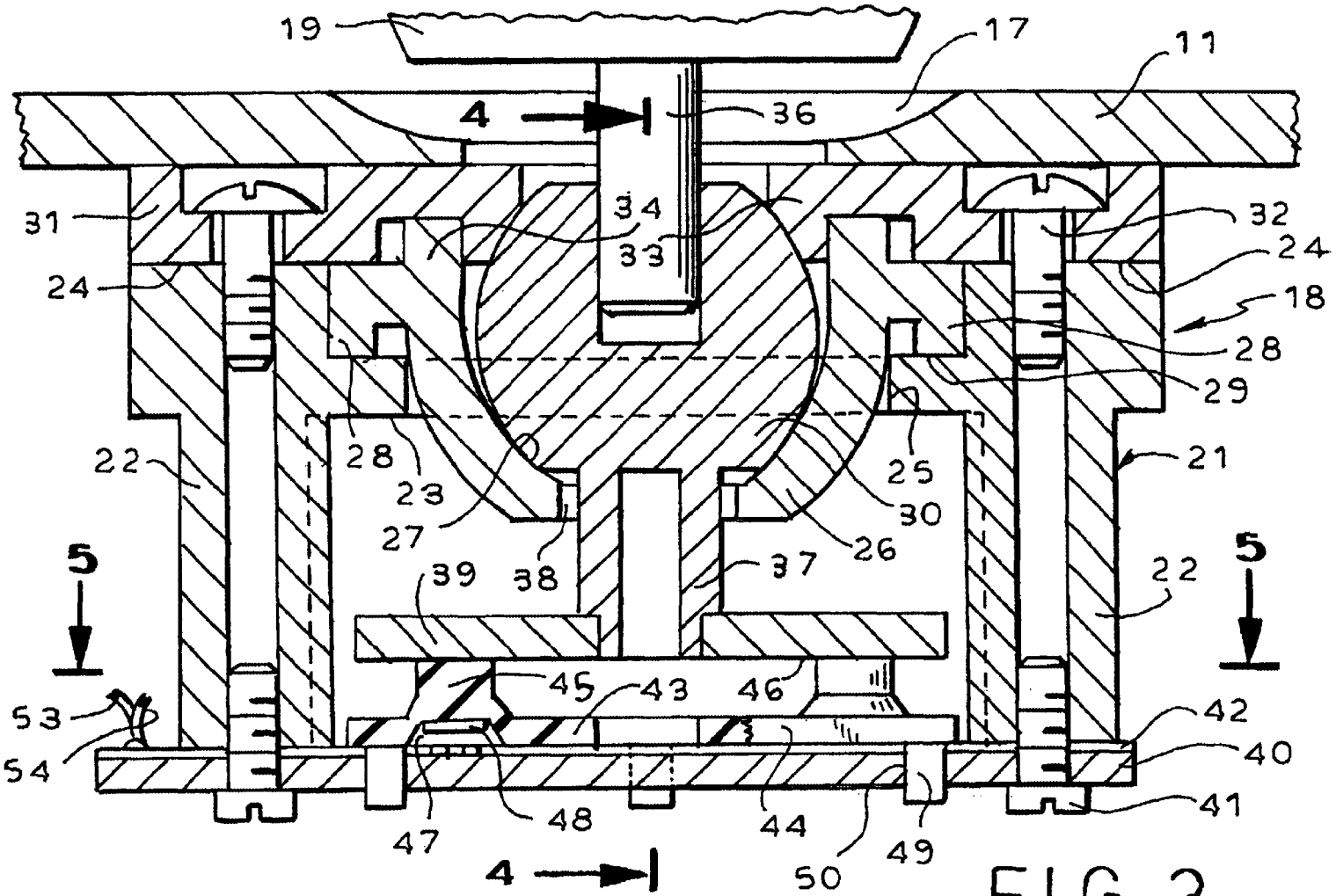
FIG. 3 is an enlarged, longitudinal cross sectional view of a contact switch incorporating features of the invention.
Figure 4:
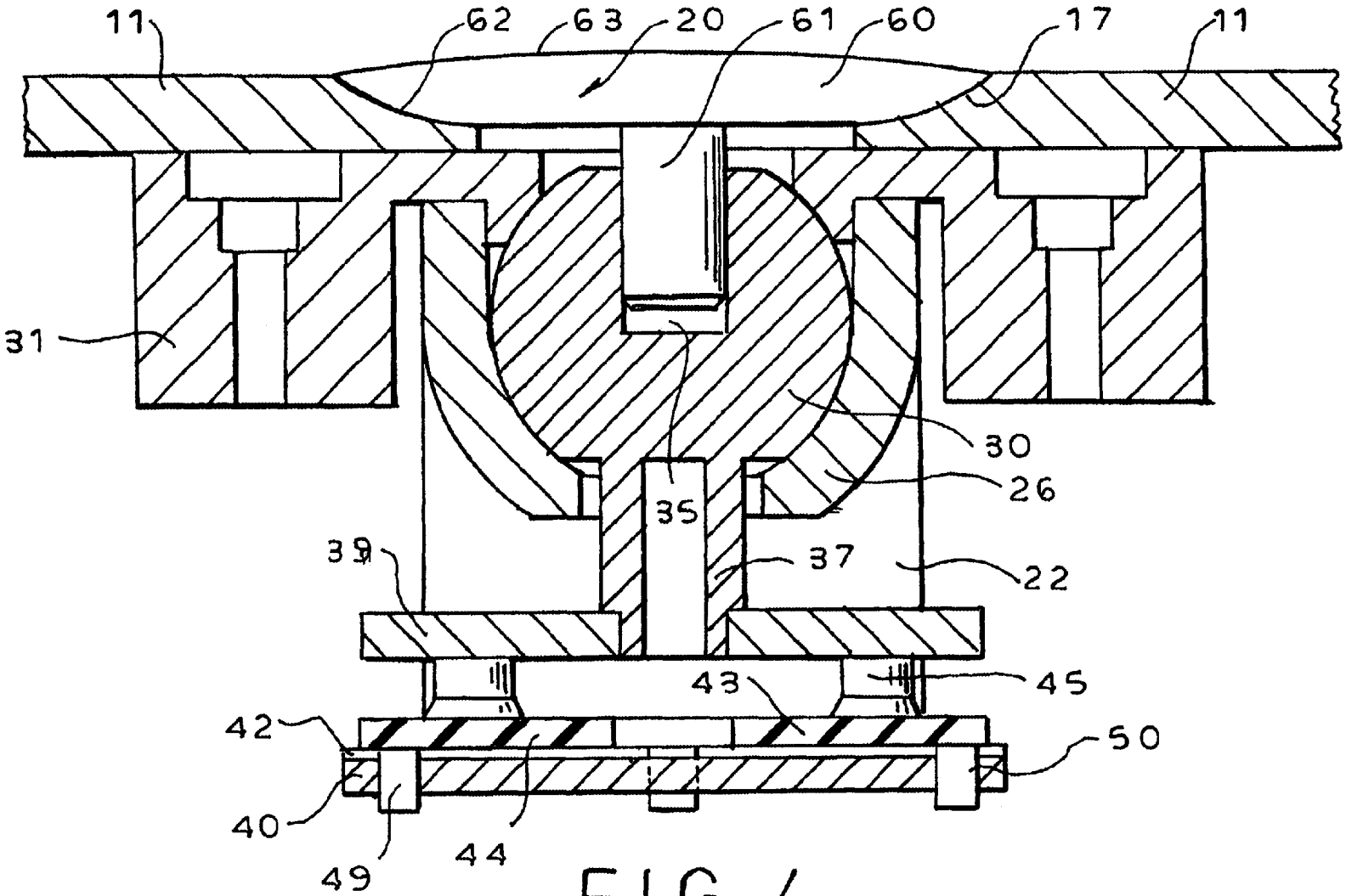
FIG. 4 is a cross sectional view as taken generally on line 4—4 of FIG. 3.
Figure 5:
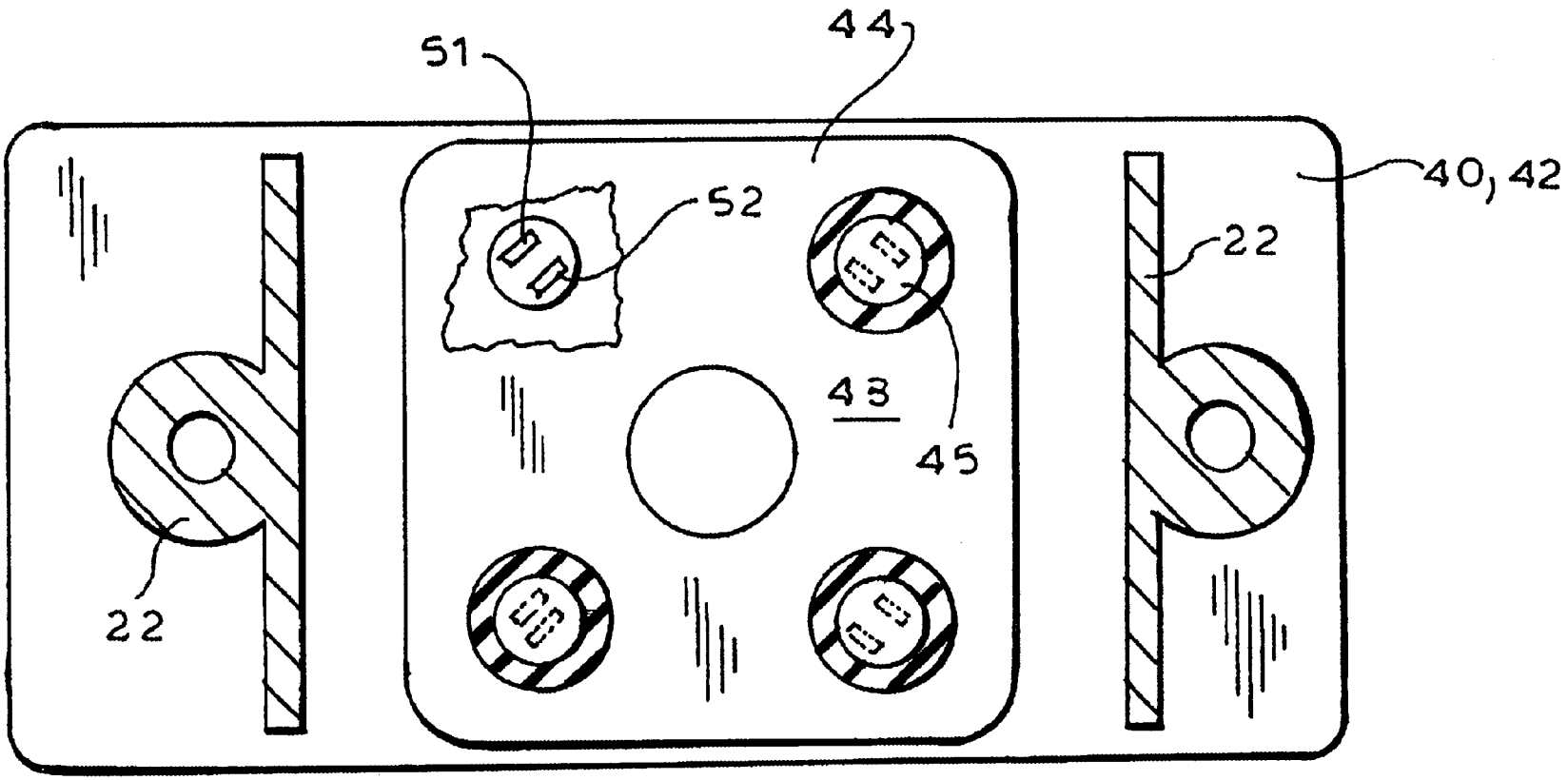
FIG. 5 is a cross sectional view as taken generally on line 5—5 of FIG. 3.
Figure 6:
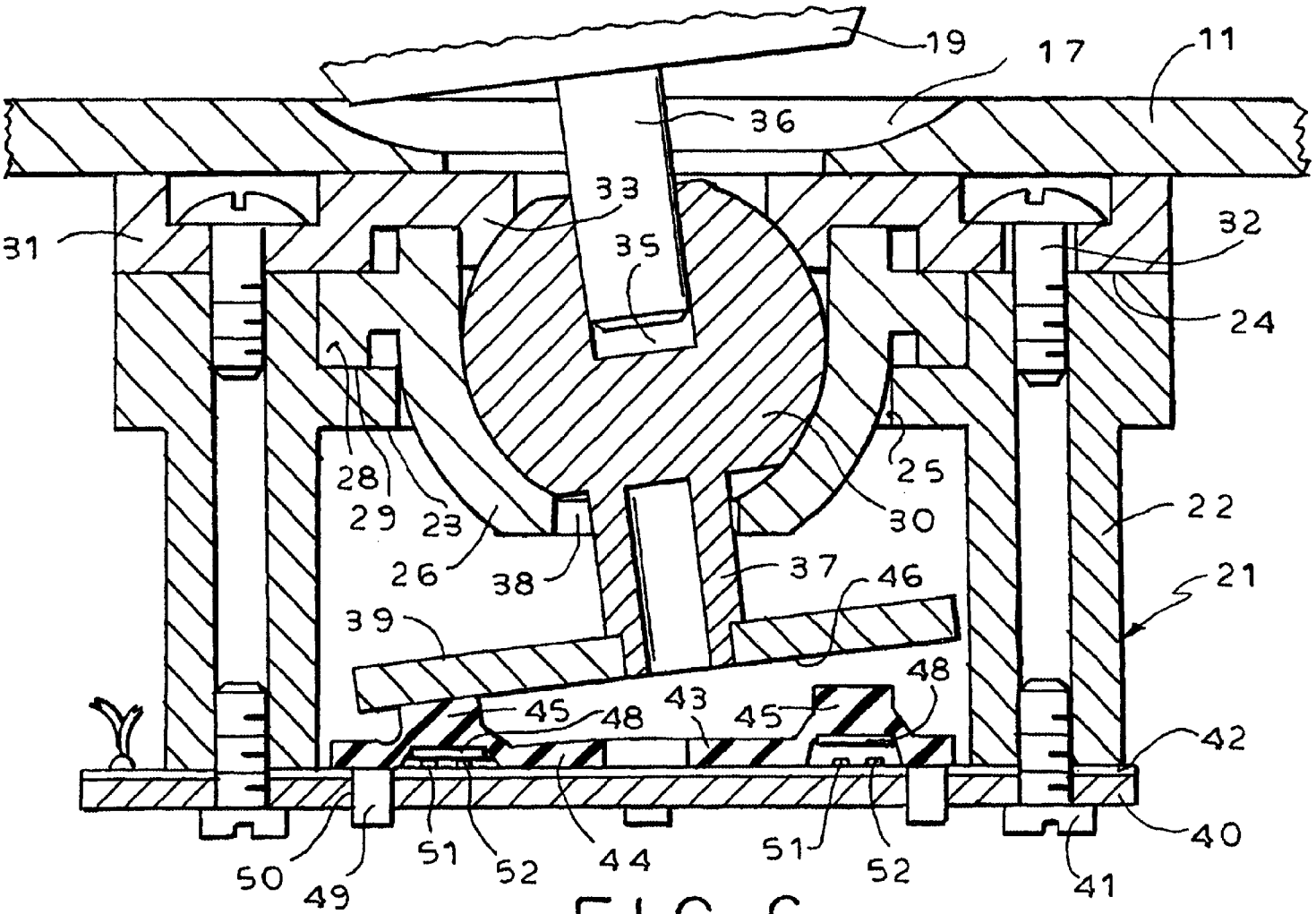
FIG. 6 is a cross sectional view similar to FIG. 3, but showing the contact switch device in a tilted or actuated position.

With particular reference now to FIGS. 4–6, a segment of the game board panel 11 is indicated, with an opening 17 formed therein, under which is mounted a contact switch 18 of a type incorporating features of the invention. In the illustrated form of the invention, the opening 17 is somewhat dish-shaped in its contours, generally as illustrated in FIG. 3.

In the form of the invention illustrated in FIG. 3, the contact switch includes a base member 21, of molded plastic material, which comprises spaced-apart legs 22 joined by a horizontal web section 23 positioned a predetermined distance below upper end surfaces 24 of the legs 22. The horizontal web section 23 is formed with a circular central opening 25 in which is received a second molded part 26. The part 26 has spherical internal contours 27 in its lower portion, and forms part of a socket assembly. Upper portions of the socket element 26 include outwardly extending mounting flanges 28 received in recesses 29 formed in upper portions of the legs 22.

A spherically contoured tilt element 30 is seated in the spherical socket element 26 and is arranged to have at least limited tilting motion in any direction. The tilt element 30 is held in place by means of a capping plate 31 which extends over the top of the base member 21 and is seated upon the upper surfaces 24 of the legs 22. The capping plate 31 which may be secured by screws 32, has a spherically contoured circular collar 33, which projects downwardly into cylindrical upper portions 34 of the socket element 26. The circular flange 33 engages upper surface portions of the tilt element 30 to retain the element 30 in its socket, while accommodating the desired universal tilting action thereof.

In the preferred form of the invention, the spherical tilt element 30 is provided with a recess 35 facing upwardly and adapted to receive a stem 36 extending downward from a contact bumper 19. The contact bumper, as shown in FIGS. 1 and 2, extends above the playing surface formed by the panels 11–13, in a position to be randomly bumped by a rolling ball 16. When thus engaged, the contact bumper 19 is tilted by the impact of the ball, causing the spherical tilt element 30 to pivot within its socket 26, generally as reflected in FIG. 6.

A spacer post 37 extends downwardly from a lower portion of the tilt element 30, passing through an opening 38 in the lower portion of the socket element 26. The opening 38 is somewhat larger in diameter than the post 37 to accommodate limited tilting movement of the spherical element 30 in any direction. A rigid circular wobble plate 39 is fixed to the lower end of the post 37. Whenever the contact bumper 19 is engaged, and tilt element 30 is tilted within the socket 26, the wobble plate 39 is tilted correspondingly, as reflected in FIG. 6. The outer edge region of the wobble plate 39, which is at the side of the assembly toward which the contact bumper 19 is tilted, will be depressed as a result of the tilting action. Inasmuch as the wobble plate 39 is circular, the tilting action of the wobble plate will be the same regardless of the direction in which the contact bumper 19 is displaced by action of the rolling ball 16.

In the illustrated form of the invention, a printed circuit board 40 is fixed to the base member 21, by means such as screws 41. The circuit board is provided with a printed circuit layer 42 which includes circuit elements (not shown) forming portions of an interrupted circuit. These circuit elements, when bridged, will complete a circuit to initiate a game activity, such as incrementation of a score, and/or creating a sound and/or activating a light, etc.

To particular advantage, the device of the invention incorporates a switching element advantageously in the form of a molded element of soft, resilient silicone rubber, for example with a hardness factor of 50–60 degrees. The switching element, in itself known for other types of usage, is comprised of a generally flat base portion 44 formed with a plurality of integral contact bumps 45 spaced uniformly about the base in positions to directly underlie outer portions of the lower surface 46 of the wobble plate 39. The contact bumps are of generally thin-walled construction and have frusto-conical side walls forming downwardly opening recesses 47. Electrically conductive contact surface elements 48 are formed in (or by) upper portions of the recesses 47.

For simplified assembly, the contact element 43 is formed with a plurality of mounting lugs 49, extending downward from the base 44 and adapted to be received snugly in openings 50 formed at corresponding locations in the printed circuit board 40. Thus, to assemble the contact member 43 with the printed circuit board, the lugs 49 are simply pushed through the openings 50 to secure the contact member snugly on the upper surface of the printed circuit board.

Pursuant to the invention, the switching element is positioned such that its contact bumps 45 are equally spaced angularly with respect to the circular wobble plate 39, so as to be engageable by the wobble plate when tilted in any direction. For the purposes of the present invention, it has been found that four uniformly spaced contact bumps is sufficient, in that tilting displacement of the wobble plate 39 in any direction will result in engagement and displacement of at least one, and in many cases two of the contact bumps 45. However, additional contact bumps may be utilized if desired.

The arrangement of the printed circuit 42 is such that a pair of contacts 51, 52 underlies each of the contact bumps 45, with each contact 51 or 52 being connected to one or the other side of the interrupted circuit such that, when the contacts 51, 52 are conductively bridged, a circuit is completed. The elements of printed circuit are suitably connected to output conductors 53, 54, so that completion of a circuit by bridging of the contacts 51, 52 can be utilized to effect some action on the game board.

As illustrated in FIGS. 3 and 4, in the "normal" position of the tilt element 30, the wobble plate 39 is horizontal, with its bottom surface closely overlying or even contacting upper surfaces of the contact bumps 45. The resilient contact bumps thus serve to bias the wobble plate to its horizontal rest position. When the contact bumper 19 is displaced by action on the game board, the resulting tilting of the bumper, together with the tilt element 30 and the wobble plate 39, results in the elastic depression of at least one of the contact bumps 45, in the manner indicated in FIG. 6. The contact surface 48 thereof is pressed downward and into contact with the spaced contact elements 51, 52, to complete a circuit in the manner indicated. No matter which direction the wobble plate 39 is tilted, it will engage and depress at least one of the contact bumps 45. When the direction of tilt is aligned between an adjacent pair of contact bumps, the wobble plate will engage and depress both of them, resulting in circuit closing contact at one or both of the contact bumps. Of course, if a second contact circuit is closed, that is simply redundant, as all the contact pairs 51, 52 in the illustrated form of the invention communicate with the same output conductors 53, 54. If desired, of course, the individual contact pairs 51, 52 could be connected to separate output conductors, such that the game response could take into account the direction from which contact was made.

In the game system of copending application Ser. No.10/059,748, it is contemplated that the game board may be reconfigured from time to time for playing different games. Such reconfiguring may involve using greater or fewer number of contact bumpers, relocating bumpers, or eliminating them altogether. To accommodate such reconfigurations, the contact bumper 19 may be pulled upward to withdraw its stem 36 from the recess 35 in the tilt element 30. A cover element 20 (see FIG. 4) which consists of a disc-like element 60 provided with a central stem 61 is applied to the board opening 17, with the stem 61 being inserted into the recess 35. The lower surface contours 62 of the cover disc correspond to the contours of the panel opening 17, such that the disc 60 fits generally flush with the surface of the game board panel, providing an uninterrupted playing surface for the reconfigured game. Preferably, the upper surface of the cover element 60 is formed with a slight (e.g., 1/16th inch) crown 63 to encourage movement of a ball away from the cover.

The device of the invention is simple and inexpensive, yet highly reliable and effective for its intended purpose. The contact switch assembly may be easily mounted on the underside of the game board panel structure, by suitable adhesive means or mechanical fasteners, in such manner as to position a universally tiltable element directly under a panel opening. The universally tiltable member is provided with a recess for the alternate reception of a contact bumper element, for actuating the tilt mechanism, or a cover element, for closing the panel board opening and providing an uninterrupted play surface, when the game configuration does not include utilization of the underlying contact switch.

The universal tilt member, which advantageously is a spherically contoured ball-like element contained within a spherically contoured socket, actuates a switch in response to tilting in any direction, by means of a wobble plate, fixed to the tilt element and cooperating with one or more contact bumps integrally formed on a soft, resilient switching element. The resilient switching element, preferably a molding of conductive silicone rubber material, is conveniently mounted on a printed circuit board by means of lugs projecting from the molded rubber element and received in openings in the printed circuit board. The overall arrangement is such that the manufacture and assembly of the contact switch device may be accomplished efficiently and inexpensively, while providing a rugged and reliable switch mechanism for the purposes intended.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A contact switch for a kinetic activity game having a panel forming a playing surface and having an opening in said playing surface, which comprises (a) a tilt element, (b) at least one socket forming elements forming a confining support for said tilt element, (c) said at least one socket forming elements being mounted to an underside of said panel in general alignment with said opening therein, (d) a bumper element, (e) said tilt element having provisions in an upper portion thereof for mounting said bumper element to project above said playing surface in a position to be engaged by a moving play element on said playing surface, (f) lateral displacement of said bumper element causing tilting movement of said tilt element, (g) said tilt element having a wobble element fixed thereto, (h) a circuit panel positioned generally opposite said wobble element and having a plurality of exposed circuit elements forming portions of at least one switching circuit, (i) a soft, resilient switching element interposed between said wobble element and said circuit panel and positioned to be elastically distorted by said wobble element when said tilt element is subjected to tilting movement, (j) said switching element having a plurality of contact surfaces thereon normally spaced slightly from said circuit panel, (k) said contact surfaces being displaceable by said wobble element into contact with said exposed circuit elements of said circuit panel to close said at least one switching circuit, (l) said resilient switching element acting elastically on said wobble element, when tilted, to bias said wobble element and said tilt element toward a normal rest position when displacing forces are released from said tilt element.

2. A contact switch according to claim 1, wherein (a) said resilient switching element is formed with a plurality of contact bumps projecting from a base toward said wobble element, (b) said contact bumps are positioned uniformly about edge portions of said wobble element such that at least one of them is engaged and displaced by said wobble element upon predetermined tilting movement of said tilt element in any direction.

3. A contact switch according to claim 2, wherein (a) said wobble element has a generally circular working surface area, (b) said contact bumps are positioned generally equiangularly about said working surface area, whereby tilting of said wobble element results in elastic displacement of one or more of said contact bumps, and (c) displaced ones of said contact bumps resiliently urge said wobble element to return to a rest position.

4. A contact switch according to claim 1, wherein (a) said tilt element is spherically contoured, and (b) said at least one socket forming elements form a confining socket for said spherically contoured tilt element for confining tilting movement thereof to rotational movements about a center of said tilt element.

5. A contact switch according to claim 4, wherein (a) a post is mounted on said tilt element and projects downward therefrom, (b) said at least one socket forming elements define an opening for said post accommodating limited tilting movement thereof with said tilt element, and (c) said wobble element is fixed to said post.

6. A contact switch according to claim 5, wherein (a) said wobble element is in the form of a circular disc.

7. A contact switch according to claim 1, wherein (a) said tilt element has an upwardly opening recess therein, (b) said bumper element has a downwardly extending stem removably received in said recess for removably mounting said bumper element.

8. A contact switch according to claim 7, wherein (a) a cover element is provided which comprises a disc-like portion of a size and shape to be received in the opening in said playing surface, (b) said cover element including a downwardly extending stem removably receivable in said upwardly opening recess in said tilt element when said bumper element is removed therefrom.

* * * * *